United States Patent [19]

Komatsu et al.

[11] Patent Number: 4,591,845

[45] Date of Patent: May 27, 1986

[54] CHARACTER AND GRAPHIC SIGNAL GENERATING APPARATUS

[75] Inventors: Shigeru Komatsu; Shigeru Hirahata, both of Yokohama, Japan

[73] Assignee: Hitachi, Ltd., Tokyo, Japan

[21] Appl. No.: 534,684

[22] Filed: Sep. 22, 1983

[30] Foreign Application Priority Data

Sep. 29, 1982 [JP] Japan ..... 57-168331

[51] Int. Cl.[4] ..... G09G 1/16

[52] U.S. Cl. ..... 340/745; 340/747; 340/748; 340/750

[58] Field of Search ..... 340/703, 721, 728, 745, 340/747, 748, 750, 751, 798, 799, 802

[56] References Cited

U.S. PATENT DOCUMENTS

| | | | |
|---|---|---|---|
| 4,394,650 | 7/1983 | Long et al. | 340/728 |
| 4,404,552 | 9/1983 | Hirahata et al. | 340/750 |
| 4,445,115 | 4/1984 | Rudgard | 340/728 |
| 4,450,442 | 5/1984 | Tanaka | 340/745 |
| 4,470,042 | 9/1984 | Barnich et al. | 340/745 |
| 4,486,746 | 12/1984 | Walker | 340/750 |
| 4,490,797 | 12/1984 | Staggs et al. | 340/703 |
| 4,498,081 | 2/1985 | Fukushina et al. | 340/721 |
| 4,504,826 | 3/1985 | Leininger | 340/745 |

*Primary Examiner*—Gerald L. Brigance

*Attorney, Agent, or Firm*—Antonelli, Terry & Wands

[57] ABSTRACT

A character and graphic signal generating apparatus of the type suitable for use with a personal computer for displaying characters and graphic patterns in a superposed relation according to a raster scan method comprises a frame buffer for storing coded character data, a DMA control unit for controlling DMA transfer of coded character data from a display RAM to the frame buffer in a non-display cycle, and units for reading out the data from the display RAM and the frame buffer in parallel relation in a display cycle so as to simultaneously derive the graphic data and the coded character data in each display cycle, whereby more display data can be read out in a unit time, and high-density display can be achieved without the sacrifice of the scanning speed.

2 Claims, 5 Drawing Figures

CHARACTER AND GRAPHIC SIGNAL GENERATING APPARATUS

BACKGROUND OF THE INVENTION

Field of the Invention

This invention relates to a character and graphic signal generating apparatus, and more particularly to such an apparatus of the type suitable for use with a personal computer for displaying characters and graphic patterns in a superposed relation according to a raster scan method.

Personal computers which are quickly spreading now in the field of office automation are generally connected to a CRT display unit of the raster scan type. In most of such personal computers, both character and graphic patterns are displayed on the display screen of the CRT display unit so as to deal with multipurpose uses. Among them, the type which displays characters and graphic patterns in a superposed relation is highly appreciated from the aspects of display effect and utility.

A system having a construction as, for example, shown in FIG. 1 has been proposed as a practical means for realizing the desired function described above. Referring to FIG. 1, the system includes a clock signal generating unit 1, a display address generating unit 3, a central microprocessor unit 40 (abbreviated hereinafter as an MPU), an MPU data bus 7, a graphic page register 8, a high-order address switching unit 10, an MPU display address switching unit 14, a readable and writable memory for display 16 (abbreviated hereinafter as a display RAM), a graphic data latch 17, a character data latch 18, a character pattern generating unit 19, a composite video signal generating unit 20 and a CRT display unit 21. In FIG. 1, reference numerals 2, 4, 5, 6, 9, 11, 12, 13 and 15 designate a display clock signal, a display low-order address signal, a raster number signal, a character high-order address signal, a graphic page selection signal, a high-order address switching signal, a display high-order address signal, an MPU address signal flowing through an address bus, and an MPU display switching signal, respectively.

The signal flow in FIG. 1 will now be described. On the basis of the display clock signal 2 generated from the clock signal generating unit 1, the display address generating unit 3 generates the display low-order address signal 4, raster number signal 5 and character high-order address signal 6 all of which are updated in each character display period. In response to the application of the high-order address switching signal 11 switching over between the former half and the latter half of one character display period, the high-order address switching unit 10 generates the display high-order address signal 12. In the former half of the character display period, this output signal 12 is the character high-order address signal 6 applied from the display address generating unit 3, and, in the latter half of the character display period, this output signal 12 is the graphic high-order address signal which is the combination of the raster number signal 5 applied from the display address generating unit 3 and the graphic page selection signal 9 applied from the graphic page register 8. On the basis of the MPU display switching signal 15, the MPU display address switching unit 14 applies the MPU address signal 13 to the display RAM in the MPU cycle and applies the display low-order address signal 4 and the display high-order address signal 12 to the display RAM 16 in the display cycle. Among the data read out from the display RAM 16 in the display cycle, that data read out in the former half of one character display period is latched in the character data latch 18, and that data read out in the latter half of one character display period is latched in the graphic data latch 17. The output signal from the character data latch 18 is converted into a character pattern signal by the character pattern generating unit 19 to which the raster number signal 5 is applied, and the character pattern signal is then applied to the composite video signal generating unit 20. On the other hand, the graphic pattern signal which is the output signal from the graphic data latch 17 is also applied to the composite video signal generating unit 20, and, after processing including parallel-serial conversion and superposition, the output signal from the composite video signal generating unit 20 is applied to the CRT display unit 21 to provide a visual display on the display screen.

FIG. 2 shows the memory map of the display RAM 16. This display RAM is composed of a parallel array of eight 64-kilobit dynamic RAMs such as, for example, those of model HM4864 made by the Hitachi, Ltd. to provide a memory having a capacity of 64 kilobytes. The former half having the capacity of 32 kilobytes is allotted to the graphic memory region, and the latter half having the capacity of 32 kilobytes is allotted to the character memory region. In FIG. 2, one page means one frame displayed on the CRT display unit 21. In the illustrated memory map, one page of character display corresponds to the capacity of 2 kilobytes capable of displaying 80 characters×25 lines, and there are 16 pages ranging from the page No. 0 to the page No. 15 for character display. One page of graphic display includes 16 kilobytes which is 8 times as large as that for character display, and this corresponds to the capacity capable of displaying 640×200 dots in one frame.

Table 1 shows the manner of allocation of 16 address bits A15 to A0 to the display RAM 16 in the display cycle. The most significant bit A15 is the bit which assigns whether the region is the former-half graphic memory region of 32 kilobytes or the latter-half character memory region of 32 kilobytes. Therefore, this bit A15 is always in the level "L" in the graphic display cycle, that is, in the latter half of one character display period and is always in the level "H" in the character display cycle, that is, in the former half of one character display period. In the graphic display cycle, the address bit A14 assigns the graphic page selection signal 9 applied from the graphic page register 8 to the high-order address switching unit 10, and the address bits A13 to A11 assign the raster number signal 5 applied to the high-order address switching unit 10. On the other hand, in the character display cycle, the address bits A14 to A11 assign the character high-order address signal 6 applied to the high-order address switching unit 10. The address bits A10 to A0 are common to both of the graphic display cycle and the character display cycle, and the display low-order address signal 4 is applied to the MPU display address switching unit 14.

TABLE 1

| Memory address bit | Graphic display cycle | Character display cycle |
|---|---|---|
| A15 | Always "L" | Always "H" |
| A14 | Graphic page selection signal 9 | Character high-order address signal 6 |

TABLE 1-continued

| Memory address bit | Graphic display cycle | Character display cycle |
|---|---|---|
| A13-A11 | Raster number signal 5 | |
| A10-A0 | Display low-order address signal 4 | |

According to the above method, the display address generating unit 3 and the display RAM 16 are provided in common to both of the character display and the graphic display, so that the overall cost and the number of parts can be reduced. However, in view of the fact that the character high-order address and the graphic high-order address are inevitably different from each other, the method is defective in that these address signals must be applied to the common display RAM 16 in a time division mode. In the case of the large-capacity, low-cost 64-kilobit dynamic RAM described above, its shortest cycle time is 270 ns. Therefore, the minimum access time required for reading in one character display period is 540 ns representing the sum of those for character data and graphic data. Even when the common low-order address bits are allotted to columns and the technique of access-time shortening called the page mode peculiar to the dynamic RAM is employed, 500 ns is considered to be the practical limit of one character display period when various margins are taken into account. In this case, the function of graphic display resolution that can be realized with one frame scanning frequency of 60 Hz which is sufficiently high compared with the afterglow time of a conventional CRT display unit is about 640 dots in the horizontal direction and 280 dots in the vertical direction.

On the other hand, in order to meet the recent requirement for display of kanji (Chinese characters), a higher resolution of about 640 dots×400 dots is required for practical use. The prior art method described above is defective in that it can not meet such a requirement.

SUMMARY OF THE INVENTION

It is a primary object of the present invention to provide a character and graphic signal generating apparatus which can achieve superposition of graphic patterns and characters and which can increase the quantity of information that can be read out for display in a unit time, while maintaining the merit of cost reduction in the aforementioned prior art method using a single display RAM for both graphic display and character display and without sacrificing the scanning speed.

The apparatus of the present invention which attains the above object comprises a frame buffer for storing a coded character signal, means for DMA transferring coded character data from the display RAM to the frame buffer in the non-display cycle, and means for reading out the data from the display RAM and the frame buffer in parallel relation in the display cycle so as to derive the graphic data and the coded character data at one time, whereby more display data can be read out in a unit time and high-density display can be achieved without the sacrifice of the scanning speed.

DESCRIPTION OF THE PREFERRED EMBODIENTS

Figure 1:
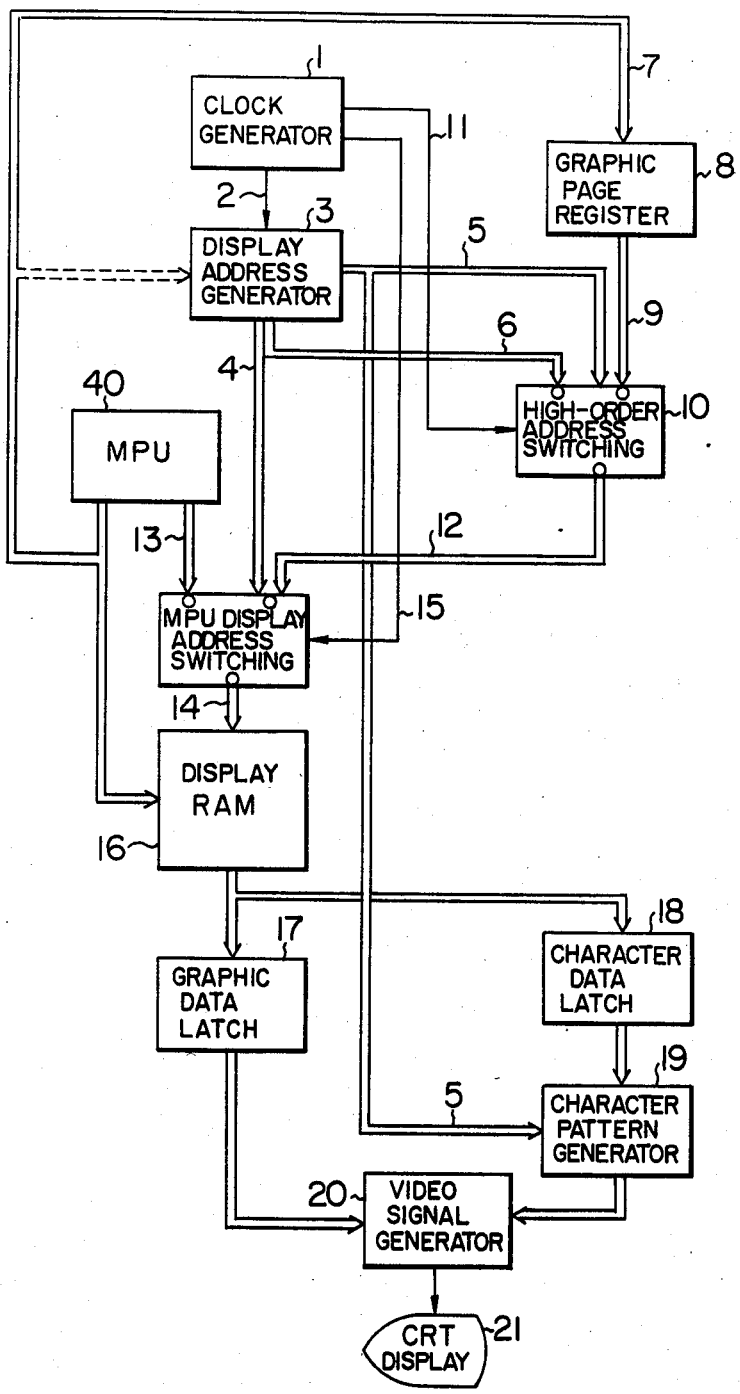
FIG. 1 PRIOR ART
FIG. 1 is a block diagram illustrating the prior knowledge of the inventor.
Figure 2:
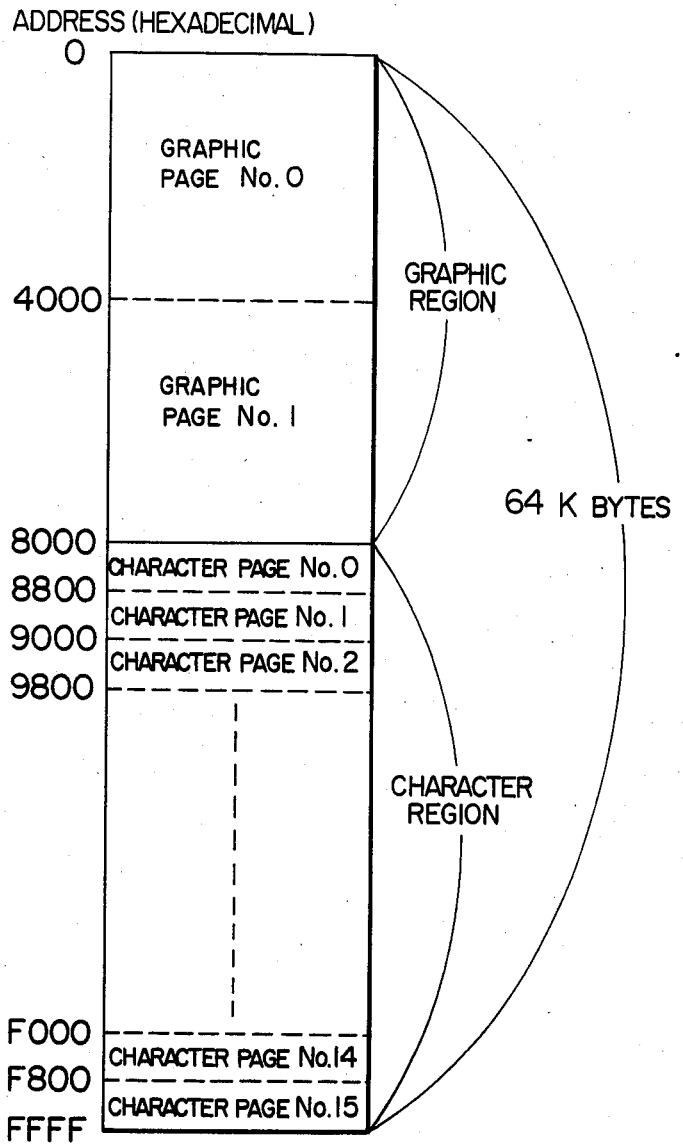
FIG. 2 PRIOR ART
FIG. 2 is a memory map in the display RAM shown in FIG. 1.
Figure 3:
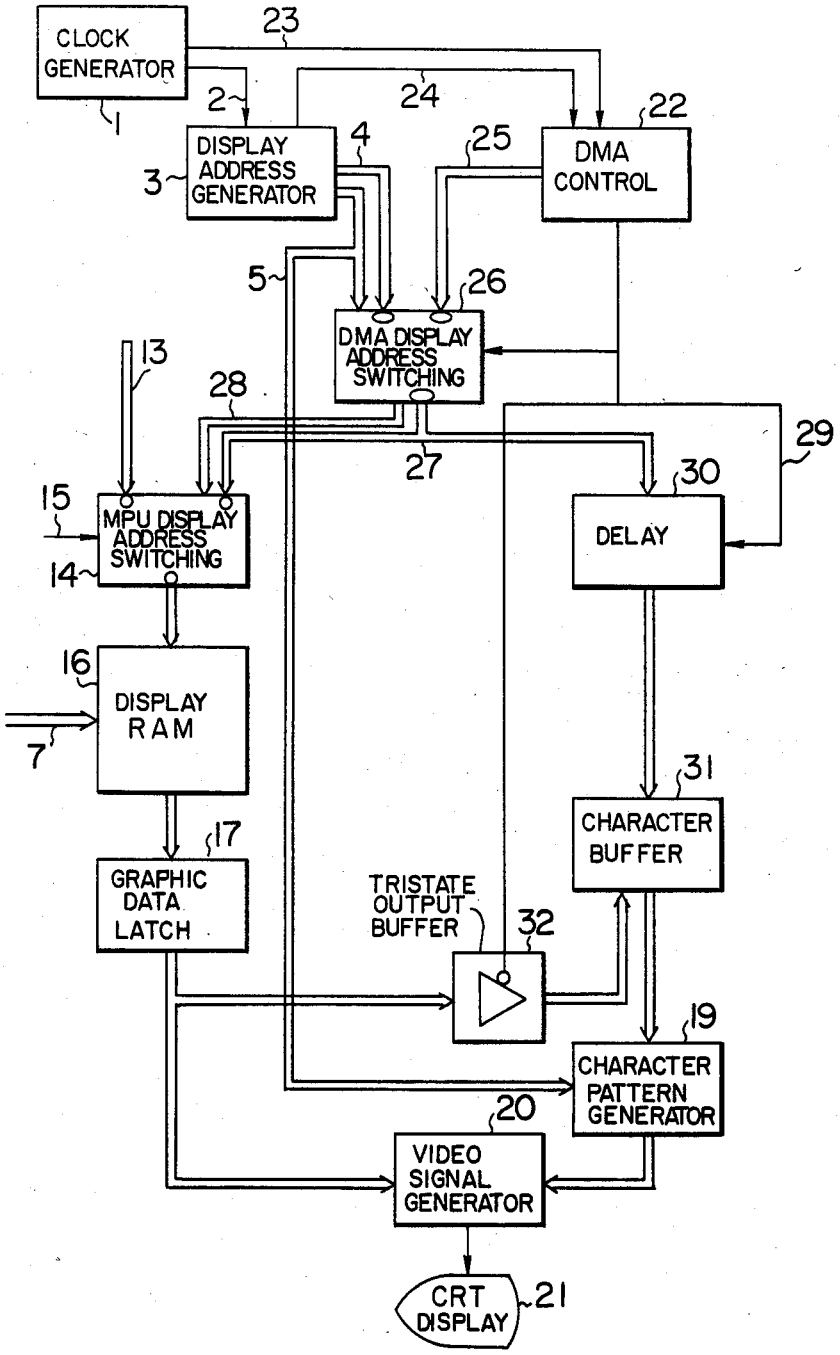
FIG. 3 is a block diagram of an embodiment of the apparatus according to the present invention.

A preferred embodiment of the apparatus according to the present invention will now be described in detail with reference to FIG. 3. In FIG. 3, the blocks and signals designated by the reference numerals 1, 2, 3, 4, 5, 7, 9, 13, 14, 15, 16, 17, 19, 20 and 21 are the same as those shown in FIG. 1 and have therefore the same functions. Those newly added in FIG. 3 include a DMA control unit 22, a DMA clock signal 23, a transfer request signal 24, a DMA address signal 25, a DMA display address switching unit 26, a display/DMA low-order address signal 27, a display/DMA high-order address signal 28, a transfer cycle signal 29, a delay circuit 30, a frame buffer or character buffer 31, and a tristate output buffer 32.

Referring to FIG. 3, the DMA transfer start address, the number of transferred bytes, etc. can be set by the DMA control unit 22 under control of the MPU 40. As soon as the transfer request signal 24 provided by the leading edge of the vertical synchronizing signal is applied, the DMA control unit 22 generates the DMA address signal 25 sequentially at the transfer speed determined by the DMA clock signal 23, and, during this period of time, the transfer cycle signal 29 becomes effective. Besides the above function, the DMA control unit 22 can also control the timing of the DMA clock signal 23 without connection with the data bus and address bus of the MPU 40. On the basis of the transfer cycle signal 29, the DMA address signal 25 applied to the DMA display address switching unit 26 is generated therefrom as the display/DMA low-order address signal 27 and display/high-order address signal 28 in the DMA transfer cycle, while the display low-order address signal 4 and raster number signal 5 applied to the DMA display address switching unit 26 are generated therefrom as the signals 27 and 28 in the other cycles. The display/DMA low-order address signal 27 is applied, in parallel relation, to the delay circuit 30 and to the MPU display address switching unit 14, while the display/DMA high-order address signal 28 is applied to the MPU display address switching unit 14. In the DMA transfer cycle, the delay circuit 30 acts to delay its input signal 27 by a length of time approximately equal to the access time for the display RAM 16 on the basis of the information provided by the transfer cycle signal 29. In the other cycles, the delay circuit 30 acts merely as a buffer and transmits the input signal 27 intact to the address signal input terminal of the character buffer 31. This delay circuit 30 may be unnecessary when the display RAM 16 and character buffer 31 are selected to dispense with such a delay function.

On the other hand, on the basis of the MPU display switching signal 15, the MPU display switching unit 14 applies the MPU address signal 13 as an address input to the display RAM 16 in the MPU cycle, and applies the display/DMA low-order address signal 27 and display/DMA high-order address signal 28 as an address input to the display RAM 16 in the display cycle. The display data read out from the display RAM 16 is temporarily latched in the graphic data latch 17. In the display cycle, the display data is applied from the graphic data latch 17 to the composite video signal generating unit 20, while, in the DMA transfer cycle, the display data from the data latch 17 is applied through the tristate output buffer 32 to the data input terminal of the character buffer 31. In the display cycle, the character data appears from the data output terminal of the character buffer 31. The character data is then applied to the character pattern generating unit 19 in which the coded character data is converted into the character pattern signal, and this character pattern signal is combined with the output signal of the graphic data latch 17 in the composite video signal generating unit 20. The resultant composite video signal is then applied to the CRT display unit 21.

The operation of the apparatus in each of the display cycle, DMA transfer cycle and MPU cycle will now be described.

Figure 4:
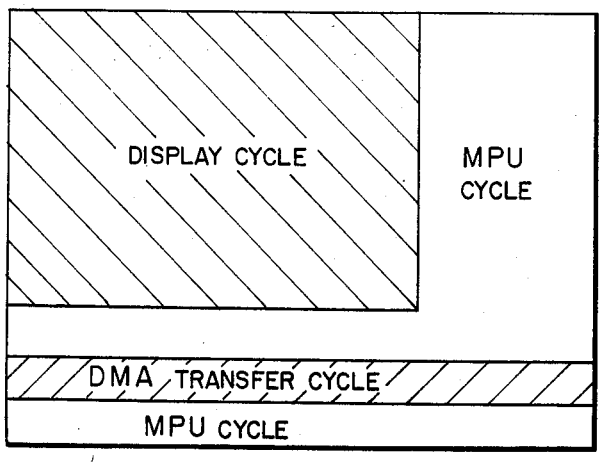
FIG. 4 is a conceptional view showing the manner of display by the apparatus shown in FIG. 3.

FIG. 4 shows the concept of the individual cycles with reference to the timing of the scanning on the display screen of the CRT display unit 21. In the display cycle, the display low-order address signal 4 and raster number signal 5 representing the graphic address are applied to the display RAM 16, and the display low-order address signal 4 corresponding to one frame of character display is also applied to the character buffer 31. The corresponding output signals appear in parallel relation from the display RAM 16 and character buffer 31 for the display of the graphic data and character data respectively.

Then, in the DMA transfer cycle, the DMA address signal 25 is applied to the display RAM 16, and the DMA address signal 25, not including the page assigning high-order bits, and is delayed by the delay circuit 30, is applied to the character buffer 31. From the assigned address of the display RAM 16, the character data corresponding to one frame is read out to be written in the character buffer 31 through the graphic data latch 17 and tristate output buffer 32. This writing operation is automatically performed for each frame, and the MPU 40 rewrites the transfer start address at the time of page switch-over only.

In the MPU cycle, the MPU address signal 13 is applied to the display RAM 16 so that the data from the MPU 40 is written in the display RAM 16 or the display data is read out from the display RAM 16 to be applied to the MPU 40. At this time, the character buffer 31 is independent of the operation.

According to this embodiment of the present invention, a frame or character buffer 31 for storing data corresponding to one page of character display is additionally provided, so that graphic data and character data can be read out in parallel relation by a single display reading operation, and, therefore, the density of displayable data is about two times as high as heretofore when the display RAM access time and scanning speed are the same. Further, because of the fact that the remainder of the region of the display RAM occupied by the graphic data functions as an equivalent of a character display RAM including a plurality of pages, the function of the display RAM is as effective as heretofore.

Another embodixent of the present invention which will be described now has fundamentally the same construction as that of the first embodiment described with reference to FIG. 3. This second embodiment differ from the first embodiment in that the display cycle is switched over to the MPU cycle after each display reading operation. In the case of the first embodiment described with reference to FIG. 3, the switch-over between the display cycle and the MPU cycle in the upper part of the display screen is, for example, such that the display cycle is switched over to the MPU cycle after display of all of 80 characters in one line. In the second embodiment to be described now, the switch-over between the display cycle and the MPU cycle is, for example, such that the display cycle is switched over to the MPU cycle after display of 2 characters. Thus, the display cycle is switched over to the MPU cycle at a shorter rate.

Figure 5:
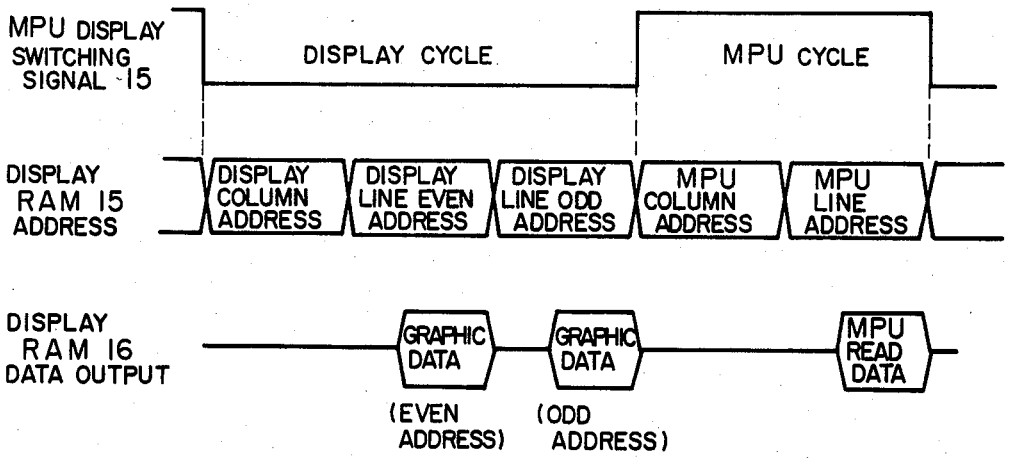
FIG. 5 is a timing chart of operation of the apparatus shown in FIG. 3.

FIG. 5 shows the timing of switch-over between the display cycle and the MPU cycle. In this second embodiment, the method called the page mode of a dynamic RAM is used to read out display data in two contiguous addresses in each display cycle. The character data from the character buffer 31 appears with the timing similar to the timing of the data output from the display RAM 16. The MPU cycle is the cycle in which the MPU 40 can read out and write data from and into the display RAM 16, and the data input to and output from the display RAM 16 are possible in this cycle only.

On the other hand, the DMA tansfer in this second embodiment is effected in the DMA transfer cycle shown by the hatching in FIG. 4, as in the case of the first embodiment.

In the second embodiment, a portion of the margin of the cycle time attributable to the parallel reading of character data and graphic data is allotted to the period of cycle steal in which the MPU 40 can read out and write data from and into the display RAM 16. Therefore, the second embodiment provides the advantages that the display processing speed of the MPU can be increased and the density of display on the display screen can be increased.

It will be understood from the foregoing detailed description that, according to the present invention, the quantity of information that can be read out for display in a unit time can be increased to about two times as many as heretofore without sacrificing the scanning speed and while maintaining the prior art economical merit of capability of superposed display of characters and graphic patterns using a single display RAM for both graphic display and character display. Therefore, the present invention is advantageous in that the display processing speed of the MPU can be increased and the density of display on the display screen can be increased.

We claim:

1. A signal generating apparatus for displaying character and graphic data comprising:

display memory means for storing coded character and graphic data corresponding to at least one display frame;

frame buffer means for storing coded character data corresponding to one display frame of said character and graphic data;

means for DMA transferring said coded character data from said display memory means to said frame buffer means in a non-display period;

graphic data fetching means for fetching graphic data in said character and graphic data from said display memory means in a display period;

coded data decoding means for fetching said coded character data from said frame buffer means and for decoding the same into pattern data in a display period; and composite video signal generating means for combining the output signals from said graphic data fetching means and said coded data decoding means and for generating a composite video signal for displaying said character data.

2. A signal generating apparatus for displaying character and graphic data comprising;

display address generating means for generating a display address signal;

display memory means having an address input terminal and a data input termial for storing character and graphic data corresponding to a plurality of display frames;

buffer memory means having an address input terminal and a data input termnal for storing coded character data corresponding to one frame of said character and graphic data;

means generating a DMA address signal for DMA transferring one frame of coded character data from said display memory means to said buffer memory means in a non-display period;

switching means for cyclically switching over between said DMA address signal and said display address signal;

means for applying the output signal of said switching means to said address input terminal of said display memory means and to said address input terminal of said buffer memory means;

means for applying an output signal of said display memory means read out in response to said DMA address signal to said data input terminal of said buffer memory means in a non-display period;

graphic data buffer means for holding said output signal of said dispay memory means read out in response to said display address signal;

coded data decoding means for decoding the output signal of said buffer memory means read out in response to said display address signal into pattern data; and composite video signal generating means for combining said output signals from said graphic fetching means and said coded data decoding means and for generating a composite video signal for displaying said character and graphic data.

* * * * *